US006105676A

United States Patent [19]

Alhamad

[11] Patent Number: 6,105,676

[45] **Date of Patent: *Aug. 22, 2000**

[54] FLAME ARRESTER

[76] Inventor: Shaikh Ghaleb Mohammad Yassin Alhamad, P.O. Box 31590, Riyadh, 11418, Saudi Arabia

[ * ] Notice: This patent is subject to a terminal disclaimer.

[21] Appl. No.: 09/133,471

[22] Filed: Aug. 13, 1998

Related U.S. Application Data

[63] Continuation-in-part of application No. 08/789,509, Jan. 27, 1997, Pat. No. 5,794,707, which is a continuation of application No. 08/695,537, Aug. 12, 1996, abandoned, which is a continuation of application No. 08/226,954, Apr. 13, 1994, abandoned, which is a continuation-in-part of application No. 08/806,901, Feb. 26, 1997, Pat. No. 5,961,416, which is a division of application No. 08/674,277, Jul. 1, 1996, Pat. No. 5,878,277, which is a division of application No. 08/417,696, Apr. 6, 1995, Pat. No. 5,740,699, which is a continuation of application No. 08/280,317, Jul. 26, 1994, abandoned.

[51] Int. Cl.[7] ..... A62C 2/00

[52] U.S. Cl. ..... 169/45; 169/66; 169/49; 220/88.1

[58] Field of Search ..... 169/45, 46, 48, 169/49, 50, 62, 65, 66, 69; 220/88.1, 88.2; 29/6.1

[56] References Cited

U.S. PATENT DOCUMENTS

| | | | |
|---|---|---|---|
| 1,086,707 | 2/1914 | Hoagland | 138/149 |
| 3,162,231 | 12/1964 | Emerson | 153/2 |
| 3,349,953 | 10/1967 | Conaway et al. | 220/85 |
| 3,356,256 | 12/1967 | Szego | 220/88.1 |
| 3,687,329 | 8/1972 | Baum | 220/88.1 |
| 3,889,757 | 6/1975 | Dunn | 169/65 X |
| 3,933,444 | 1/1976 | Kilgore | 48/192 |
| 4,149,649 | 4/1979 | Szego | 169/66 X |
| 4,249,669 | 2/1981 | Szego | 220/88.1 |
| 4,265,317 | 5/1981 | Knecht | 169/50 |
| 4,361,190 | 11/1982 | Szego | 169/48 |
| 4,405,076 | 9/1983 | Lines, Jr. et al. | 428/921 |
| 4,613,054 | 9/1986 | Schrenk | 220/88.1 |
| 4,621,397 | 11/1986 | Schrenk | 29/6.1 |
| 4,844,974 | 7/1989 | McCullough, Jr. et al. | 428/920 |
| 4,958,554 | 9/1990 | Spaeth | 169/48 X |
| 5,088,170 | 2/1992 | Spath | 29/6.1 X |
| 5,247,822 | 9/1993 | Spath | 29/6.1 X |
| 5,495,894 | 3/1996 | Spath | 169/48 |
| 5,794,707 | 8/1998 | Alhamad | 169/69 |
| 5,816,332 | 10/1998 | Alhamad | 169/45 |

FOREIGN PATENT DOCUMENTS

| | | | |
|---|---|---|---|
| 0256239 | 2/1988 | European Pat. Off. | 169/45 |

*Primary Examiner*—Andres Kashnikow
*Assistant Examiner*—Steven J. Ganey
*Attorney, Agent, or Firm*—Charles E. Cates; Frank T. Barber

[57] ABSTRACT

A highly efficient flame arrester adapted for use in preventing an external flame from backflashing upstream in a pipe, or a conduit, or a stream carrying a flammable substance. The flame arrester comprises a contained layer of nested ellipsoids formed from expanded metal sheets made from magnesium alloy foil. The arrester is useful in fuel tanks, combustion systems, sea-going tankers, hot water or space heaters, and the like.

11 Claims, 3 Drawing Sheets

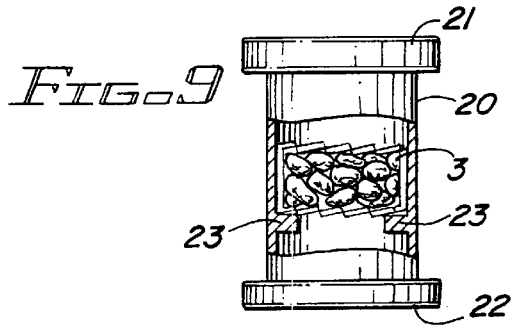
FIG. 9
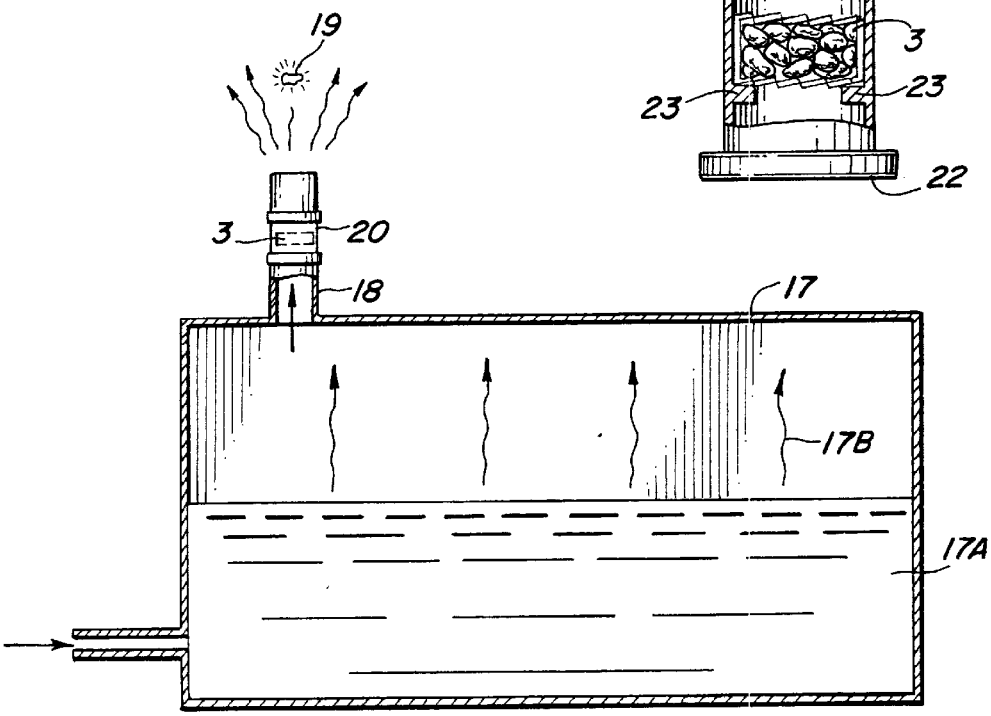
FIG. 8
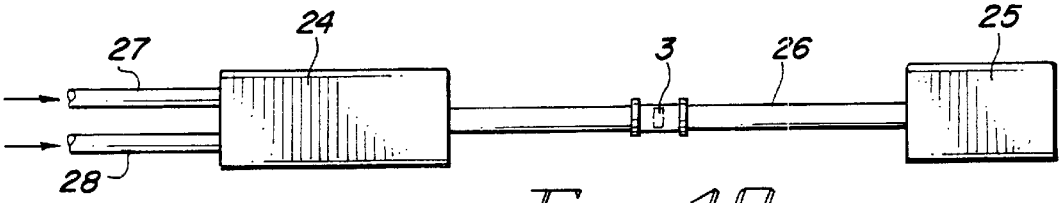
FIG. 10
FIG. 11
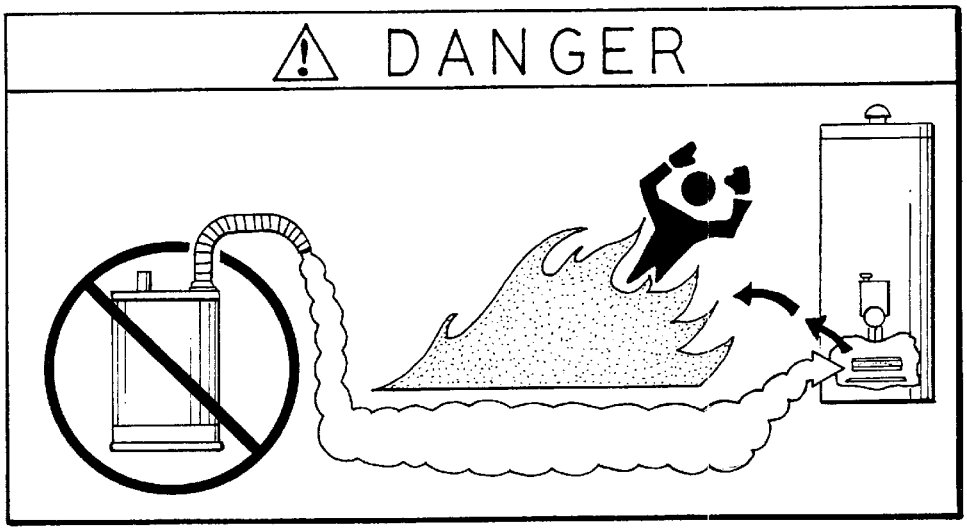

FLAME ARRESTER

This application is a continuation-in-part of application Ser. No. 08/789,509, filed Jan. 27, 1997, now U.S. Pat. No. 5,794,707 which is a continuation of application Ser. No. 08/695,537, filed Aug. 12, 1996 (now abandoned), which was a continuation of application Ser. No. 08/226,954, filed Apr. 13, 1994 (now abandoned), which was a continuation-in-part of application Ser. No. 08/806,901, filed Feb. 26, 1997 (now Pat. No. 5,961,416 which is a division of application Ser. No. 08/674,277, filed Jul. 1, 1996 (now Pat. No. 5,878,277, which was a division of application Ser. No. 08/417,696, filed Apr. 6, 1995 (now Pat. No. 5,740,699, which was a continuation of application Ser. No. 08/280,317, filed Jul. 26, 1994 (now abandoned).

BACKGROUND AND PRIOR ART

The present invention relates to a flame arrester or fire-check device that is adapted to prevent a backfire from traveling upstream through a stream of flammable gas, and thus prevent unwanted fire or explosion that might otherwise be caused by the backfire.

A flame arrester is a passive device that permits the flow of gas, but prevents any external flame or backfire from "flashing back" through the flow of gas to the source of flammable material. If such a flashback is not prevented, the reservoir of flammable material would ignite, resulting in a destructive fire or explosion. Devices to prevent the passage of flame are critical to processes where flammable chemicals or vapors or handled, such as in petrochemical refineries, pipelines, sea-going tankers, combustion systems, hot water heaters, space heaters, and the like.

An example of an application requiring the use of a flame arrester is the vent opening normally provided on storage tanks containing oil, gas or other volatile substances, such vent opening being automatically operable to permit the escape of vapors when internal pressure exceeds a predetermined amount. Under some atmospheric conditions there is a tendency for the escaping vapors to saturate the atmosphere surrounding the tank to the point of inflammability, and in the event of accidental ignition when the vent is open, a flame arrester must be provided if the resulting combustion is to be prevented from traveling either slowly or explosively into the tank.

As another example, flame arresters are incorporated in combustible fuel lines and are used to protect the combustion system and its components from damage and to protect and safeguard operating personnel from injury resulting from deflagration and detonation caused by flashback. The flame arrester normally includes a burner screen which is intended to prevent the passage of flame from the system burner back to the gas-air mixture device.

Flame arrester elements are usually constructed of various open-structured metal configurations, such as perforated plates, bundles of tubes, screens, or beds of granules or fibers. The ability of any element to intervene and prevent the passage of fire, a first time, and over time, depends to a certain extent on the diameter and length of the array of its internal passages.

A difficulty which is commonly encountered is that most open-structured configurations which possess the required internal passage dimensions for successfully arresting a flame are able to survive the heat of the flame for only a limited time. When unwanted ignition takes place, there is normally a continued burning on the emergent face of the arrester over a relatively long period of time while the source of burning vapors is still present. Such extended exposure to the high temperature of the flame is normally destructive of the arrester, and therefore it is common practice to provide mechanical or other means responsive to the temperature of the arrester for closing a valve or otherwise shutting off the source of burning vapors. The burner screen in the arrester therefore acts only as a short term firecheck until more effective measures can be taken. However, the need for the mechanical or other means introduces additional expense, constant service and maintenance, and an additional array of moving parts which can malfunction.

A further difficulty is that, under certain ignition or detonation conditions, a rapidly developing shock wave will precede the flame front and can damage or completely destroy the open-structured configurations of the flame arrester elements before they have an opportunity to perform their flame arresting function.

It is an object of the present invention to provide a flame arrester which permits the normal flow of gas but produces substantially enhanced flame arresting properties.

It is another object of the invention to provide a flame arrester which is superior in its ability to resist melting when exposed to high temperature flames and to survive the force of shock waves encountered with unwanted ignitions.

It is a further object to provide a flame arrester which has no moving parts and is operative, without adjustment, when placed in any fuel or vent line.

It is a still further object of the invention to provide a flame arrester which is simple, durable, inexpensive to manufacture, easy to assemble, and relatively maintenance free.

SUMMARY OF THE INVENTION

This invention is based on the discovery that a flame can be prevented from flashing back in an upstream direction through a stream of flammable gas by placing in the stream an arrester comprising a contained layer or layers of nested ellipsoids formed from expanded metal sheets produced from a magnesium foil. It has been found that the expanded metal net magnesium alloy ellipsoids not only arrest the upstream travel of the flame but also withstand the extreme heat of the flame and survive any shock wave that may be associated with the ignition of the flame.

The product of the present invention therefore is a flame arrester adapted for placement in a stream of flammable atmosphere for preventing an external flame at a downstream point in the stream from flashing back in an upstream direction to the source of the flammable atmosphere, said arrester comprising a contained layer of nested ellipsoids formed from expanded metal sheets made from magnesium alloy foil.

In one embodiment hereinafter described the flame arrester is placed in the vent pipe of a storage tank for a flammable substance. In another embodiment, the arrester is located in a conduit of a closed combustion system. In a further embodiment, the arrester is used to prevent the pilot or burner light of a hot water heater or space heater from igniting a fugitive flammable atmosphere caused by the accidental spillage of fuel in the vicinity of the heater.

The invention also comprises a method for preventing a supply of flammable atmosphere from being ignited by a flame burning externally of said atmosphere, comprising the step of placing the above-described arrester between said flame and said atmosphere.

BRIEF DESCRIPTION OF THE DRAWINGS

FIG. 8 is a schematic cross-sectional view of a fuel storage tank, showing the flame arrester of the present invention placed in the vent pipe.

FIG. 9 is an enlarged cross-sectional view of the vent pipe of the fuel storage tank of FIG. 8, showing the flame arrester in place.

FIG. 10 is a schematic view of an enclosed combustion system, showing the flame arrester of the present invention placed in the conduit connecting the gas-air mixture device and the burner.

FIG. 11 is a warning sign recommended by the U.S. Consumer Product Safety Commission regarding the danger of storing gasoline in proximity to gas-fired water heaters.

DETAILED DESCRIPTION OF THE INVENTION

Figure 1:
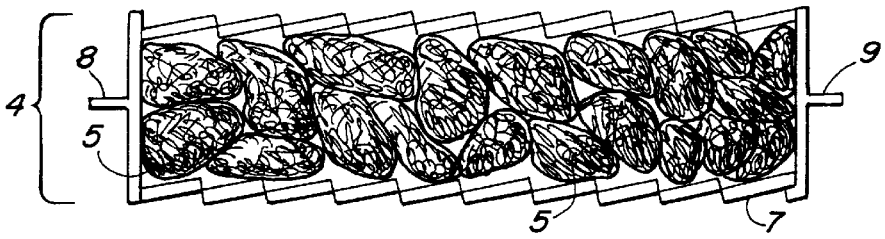
FIG. 1 is a cross-sectional view of the flame arrester of the present invention, showing layers of ellipsoids contained between sheets of expanded metal net.

Referring to the drawings, the basic structure of the flame arrester of the present invention is shown in FIG. 1, wherein the arrester 3 includes a layer 4 of nested ellipsoids 5 formed from expanded metal sheets made from magnesium alloy foil. The layer 4 is contained between sheets 6 and 7 of expanded metal foil. Although not essential to the invention, it is desirable for certain purposes that the edges of sheets 6 and 7 be brought together and bound by stitching, stapling or other known fastening means at seams 8 and 9. The flame arrester 3 may be square, rectangular, round, or any other shape to fit the cross-section of the pipe in which it is placed.

Figure 2:
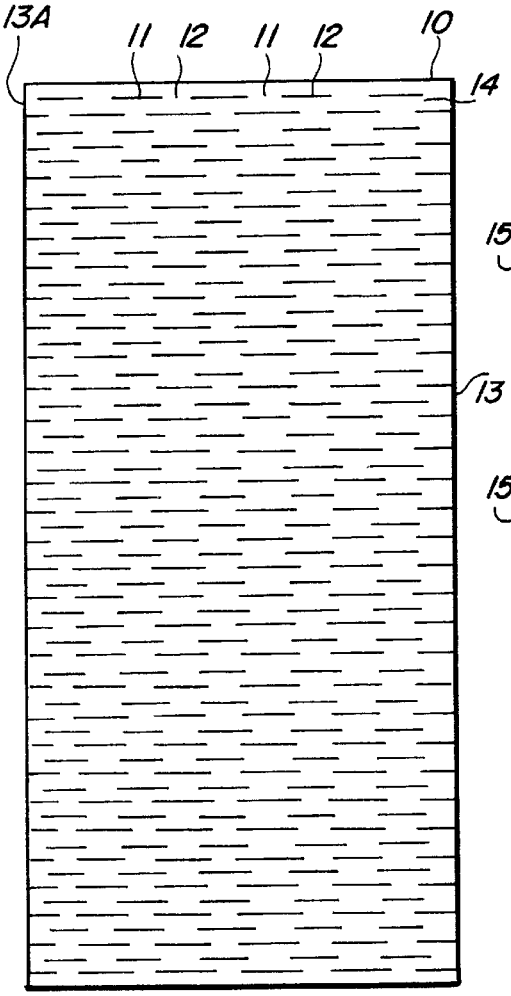
FIG. 2 is a top view of a slitted magnesium alloy foil sheet, which can be expanded by stretching to provide the expanded metal net usable in the present invention.

The expanded metal employed in forming the ellipsoids 5 and the sheets 6 and 7 is formed by slitting a continuous sheet of magnesium alloy metal foil in a specialized manner and then stretching the slitted sheet to convert it to an expanded prismatic metal net having a thickness substantially greater than the thickness of the foil. Referring to the drawings, FIG. 2 shows a sheet of metal foil 10 provided with discontinuous slits appropriate for the present invention. The length and width of the sheet may be chosen from any number of practical dimensions, depending on the size of the flame arrester to be produced.

As noted in FIG. 2, sheet 10 is provided with discontinuous slits 11 in spaced apart lines which are parallel to each other but transverse to the longitudinal dimension of the sheet 10. The slits 11 in each line are separated by unslit segments or gaps 12, and it will be noted that the slits 11 in each line are offset from the slits 11 in adjacent lines. Similarly, the gaps 12 in each line are offset from the gaps 12 in adjacent lines. The lines of slits run parallel to the longitudinal edges 13 and 13A of the continuous sheet of metal foil. Methods and apparatus for producing the slitted metal foil are described in detail in U.S. Pat. No. 5,095,597, dated Mar. 17, 1992 and U.S. Pat. No. 5,142,735, dated Sept. 1, 1992.

Figure 3:
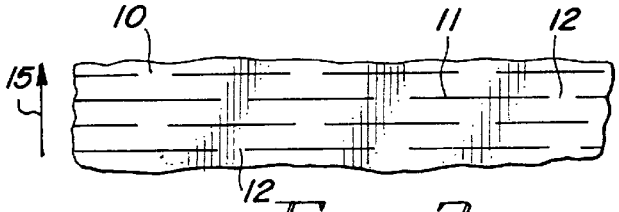
FIGS. 3 through 6 are top views of the expanded metal net, showing the changes in configuration as the slitted sheet is pulled to open up the expanded metal net.
Figure 4:
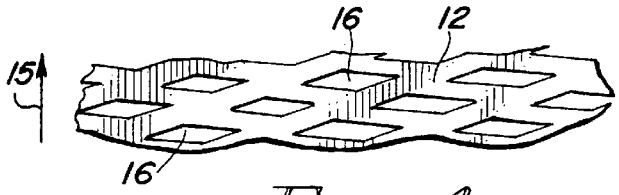
Figure 5:
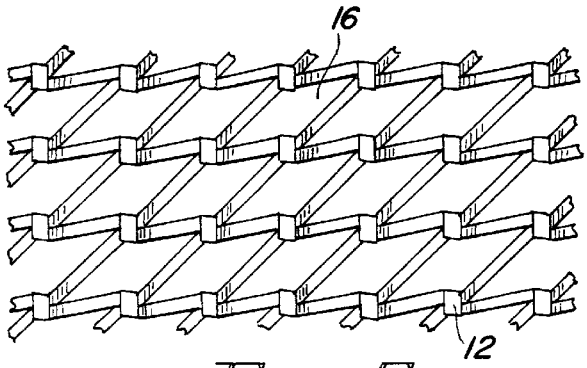
Figure 7:
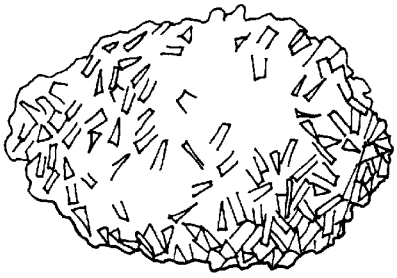
FIG. 7 is a perspective view showing the ellipsoid form made from the expanded metal net, for use in the present invention.
Figure 6:
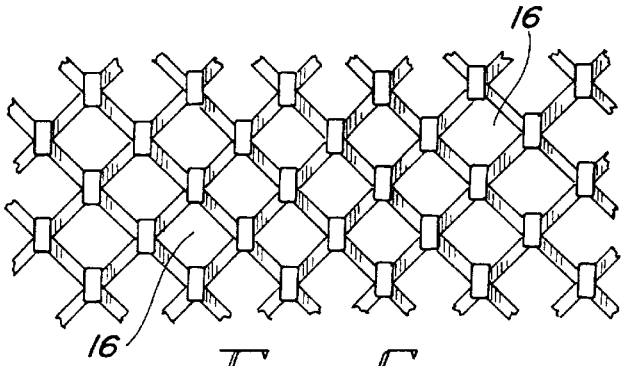

When the slitted metal foil as shown in FIG. 2 is stretched by subjecting it to longitudinal tension, it is converted into an expanded metal prismatic net, usable as elements 6 and 7 of the present invention. In the stretching procedure, the horizontal surfaces of foil are raised to a vertical position, taking on a honeycomb-like structure. This conversion is shown in FIGS. 3 through 6 of the drawings. The slitted metal foil 10 is shown in FIG. 3 prior to stretching. When longitudinal tension is applied in the direction of arrow 15, the slits 11 begin to open and are converted to eyes 16, and the product assumes the appearance shown in FIG. 4. The application of more tension causes a greater opening of the slits, and the product expands into the honeycomb-like, prismatic form shown in FIG. 5. When even further tension is applied, the configuration reaches its desired end point, as in FIG. 6. The conversion illustrated in FIGS. 3 through 6 is accompanied by an increase in thickness of the product, the final thickness of the honeycomb product being approximately twice the value of the space 14 between each line of slits. Each eye of the expanded sheet has a three-dimensional structure having eight corner points.

The ellipsoids 5 are produced by cutting the expanded metal net sheets 6 or 7 into small segments which are then mechanically formed into small ellipsoids. The ellipsoids 5 generally have a short diameter in the range of 20 to 30 mm, and a long diameter in the range of 30 to 45 mm, with the distance between focal points measuring approximately two-thirds of the long diameter of the ellipsoid. Their ellipsoid shape causes them to nestle closely together when placed in a contained position, so that complete surface coverage is obtained, with no gaps through which flame can pass. Apparatus for producing these ellipsoids is described in detail in U.S. Pat. No. 5,207,756, dated May 4, 1993.

The kind of metal used in the metal foil should be an alloy of magnesium with suitable compatible substances. Thus, for example, it is desirable to use an alloy of magnesium with substances such as aluminum, copper, zirconium, zinc, strontium, Rn(electron), silicon, titanium, iron, manganese, chromium, and combinations thereof. Alloys such as the above have the valuable characteristic of not only being lightweight, strong, elastic, heat-conductive, etc., but also the important characteristic of being nonflammable at high temperatures. A particularly useful combination is the alloy of magnesium with aluminum and copper. Another preferred combination is the alloy of magnesium with zirconium and strontium. The invention is illustrated in a specific example by an alloy comprising 0.25% Si, 0.3% Fe, 0.01% Cu, 0.01% Mn, 10% Al, 0.1% Zn, 0.08% Ti, and the remainder Mg. Such a product possess tensile strength of 300 N/mm, proof stress of 200 n/mm, elongation of 10%, and Brinell hardness of (5/250-30). The magnesium alloy used in the invention should contain at least 3.0% magnesium.

By controlling the extent of stretching, as well as the dimensions of the slits 11, the gaps 12 between slits, and the spaces 14 between lines of slits, it is possible to take advantage of the strength, hardness and other properties of the magnesium alloy foil to produce expanded nets which may be formed into products having exceptionally high specific internal surface areas (e.g., in the range of 250 to 325 $ft^2$ per $ft^3$ and above); exceptionally high porosity (e.g., in the range of 80 to 99%); and a volume resistivity of <50 ohm-m. These characteristics make the expanded metal net particularly useful in the production of flame arresters having superior performance characteristics. In order to provide expanded nets with the high specific internal surface area and high porosity referred to above, it is important to use an alloy foil containing at least 3.0% magnesium, and preferably the magnesium content of the alloy should be above 50%—i.e., magnesium should be the major component in the alloy. It is also preferred that the space between lines of slits be in the range of 2–6 mm; that the length of the slits be within the range of 1–2.5 centimeters; and that the thickness of the foil be between 0.05 and 1.0 mm.

For certain uses, the expanded metal foil used in the present invention may be combined with other materials. For example, if the foil is coated with an alkaline bichromate, the resulting expanded metal net acts as a corrosion inhibitor, since the bichromate acts to remove water from fuels and their containers. Further, if the metal foil is combined with oleates or similar compounds, the fire extinguishing capability of the expanded metal net is enhanced, since the oleate emits a dense vapor which assists in smothering the flame.

FIG. 8 schematically represents a typical application for the flame arrester of the present invention in the vent pipe of a storage tank for flammable substances. In the embodiment shown, there is a fuel storage tank 17 partially filled with fuel 17A. In the upper portion of the tank, there is a vapor pressure caused by the vapors 17B emanating from the body of fuel 17A. A vent pipe 18 is provided in the cover of the tank for the release of vapors when the vapor pressure exceeds a predetermined limit. When vapors are released out the upper end of the pipe 18, they mix with the surrounding atmosphere, and the vapor-air mixture at this point is very often in the flammable range. The possibility that such flammable mixture will be ignited by a spark 19 requires a flame arrester or firecheck to prevent the resulting flame from flashing back into the fuel tank and burning or exploding the contents.

In FIG. 8, a flame arrester pipe segment 20, containing the flame arrester 3 of the present invention, is placed in the vent 18 to stop the passage of flame back into the fuel tank. When burning vapors flash back in vent 18, they reach the emergent face of flame arrester 3 and continue to burn at that point but do not penetrate any further upstream in vent 18.

FIG. 9 is an enlarged cross-sectional view of the arrester pipe segment 20 and the flame arrester 3 contained within it. Segment 20 is a separate unit which may be readily removed for inspection and servicing. It includes shoulders 21 and 22 for mating with matching shoulders (not shown) on the vent pipe 18, and it also includes an abutment 23 on which the flame arrester 3 may rest.

It has been found that the combination of features in the present invention, including the magnesium alloy, the high specific internal surface area, and the nested ellipsoidal shape of its honeycomb-like components, produces a superior flame arrester. Most fire arresters function by providing apertures small and long enough to extract heat from a flame faster than it can be generated by chemical reaction, thereby preventing the flame from propagating further into the flammable atmosphere. Characteristic aperture dimensions are called hydraulic diameter, $H_d$, and passage length, $P_l$. In the prior art, these critical dimensions are provided by the flame arrester "element", which, as previously mentioned, can consist of tube bundles, perforated plates, screens, gauze, beds of beads or fibers, porous media, or, most often in practice, parallel plates or crimped ribbons. Every flammable material (e.g., ethylene, methane, gasoline, etc.) requires different critical flame arrester design dimensions, which are related to flame speed.

In rating tests which have been conducted, the flame arrester of the present invention has been demonstrated to be effective with respect to a wide variety of flammable substances over a wide range of flame speeds, and has shown superiority to known arrester elements. For example, available research information shows that a crimped metal-ribbon arrester (one of the most efficient of the prior art elements) having an $H_d$ of 0.015 inch and a $P_l$ of 1.5 inches is capable of arresting a high-speed ethylene/air flame in only 5 out of 19 flashback tests; whereas the arrester of the present invention, having the same hydraulic diameter and passage length dimensions, was shown to arrest the same high-speed ethylene/air flame in 10 out of 10 flashback tests.

Further, the nested ellipsoids of the present invention, formed from expanded metal sheets of magnesium foil, resist melting at temperatures as high as 1200 degrees C. and thus overcome the disadvantage of prior art meltable arresters, which function only as a short term expedient, and which must be associated with and supplanted by valve closing mechanisms when flashback is encountered. The arrester of the present invention therefore allows elimination of the costly and failure-prone valve closing mechanisms utilized in the prior art, although it may be desirable to use the arrester of the present invention in conjunction with temperature responsive elements for sounding an alarm.

Still further, the structure of the present invention has the surprising capability of dissipating shock waves resulting from explosions. Tests with anti-explosion pads comprising contained nested ellipsoids formed from expanded metal net made from magnesium alloy foil, and having the high specific internal surface area of the present invention, have demonstrated remarkable protection against the destructive forces of an explosion. For example, a concrete block wall covered with an anti-explosion pad made from the components of the present invention suffers no damage from a ten-pound TNT bomb detonated 5 inches in front of the wall; whereas, without the pad, the wall is obliterated. Protection against even stronger charges can be accomplished with additional layers of nested ellipsoids. Thus, in protecting against flashback in a stream of flammable gas, in instances where a rapidly developing shock wave precedes the flame front, the flame arrester of the present invention possesses significant shock-dissipating properties enabling it to survive the blast.

FIG. 10 illustrates a comparable application for the flame arrester of the present invention in protecting a combustion system and its components against flashback. The system comprises a gas-air mixing compartment 24 and a burner compartment 25 connected by a conduit 26. A gas line 27 and an air line 28 lead into the compartment 24. In operation, the gas and air are mixed in compartment 24 and passed through conduit 26 to burner compartment 25 where they are burned to produce the desired power. The flame arrester 3 of the present invention is placed in conduit 26 to prevent the flame in burner 25 from flashing back to the combustible mixture contained in compartment 25.

FIGS. 11 through 14 illustrate a unique application of the flame arrester of the present invention in protecting gas-fired hot water heaters or space heaters from igniting accidentally spilled gasoline or other vapor producing flammable materials in the vicinity of the heater. According to data gathered by the U.S. Consumer Product Safety Commission (CPSC), between 1984 and 1988, there were an estimated 40,000 fires involving residential gas-fired water heaters, resulting in 200 deaths, 3,000 injuries, and $500 million in property loss, statistics which make this appliance eminent as a fire hazard. (See Smith, L., "National Estimates: 1988 Residential Fire Loss Estimates", United States Consumer Product Safety Commission Memorandum to J. Hoebel, Washington, D.C., Jun. 27, 1990.) The most probable cause for many of the fires was the ignition of "fugitive" flammable atmospheres surrounding properly operating water heaters. The fugitive flammable substance most often accidentally ignited by water heaters was gasoline, stored/spilled and handled/mishandled in garages, where water heaters are typically installed when a house has no basement.

In response to this clear and present fire danger, the CPSC has recommended that manufacturers provide consumers with a written warning that gas-fired heaters should not be installed or operated in any residential enclosure where flammable vapors are likely to be present, that gasoline or other flammable liquids should not be stored in the vicinity of a water heater, and that proper housekeeping be maintained. FIG. 11 shows a reproduction of this rather graphic warning, in universal pictorial form.

Similarly, building codes have required for some time that gas-fired water heaters shall not be installed in any garage unless their ignitors, pilots, and burners are located not less than 18 inches above the floor. Future revisions may require that manufacturers of gas-fired water heaters either reinstall existing floor-level gas-fired heaters to an 18-inch elevation or retrofit all floor-level gas-fired heaters with an effective means for fire-safing these appliances in the presence of fugitive gasoline vapors.

Tests which have been conducted with respect to the flame arrester of the present invention demonstrate that it provides the effective means which has been sought. The following Example 1 describes a water-heater fire-safety demonstration which has been carried out:

EXAMPLE 1

Figure 13:
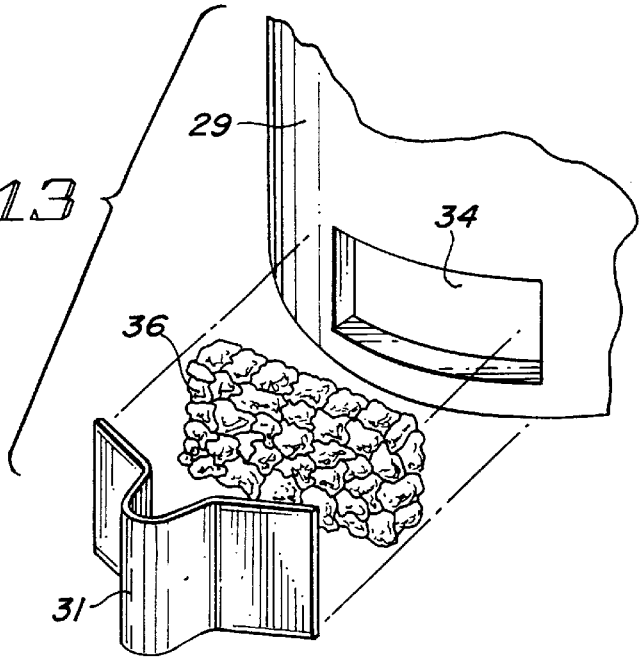
FIG. 13 is a schematic enlarged view of the burner access panel, showing placement of the flame arrester of the present invention.
Figure 12:
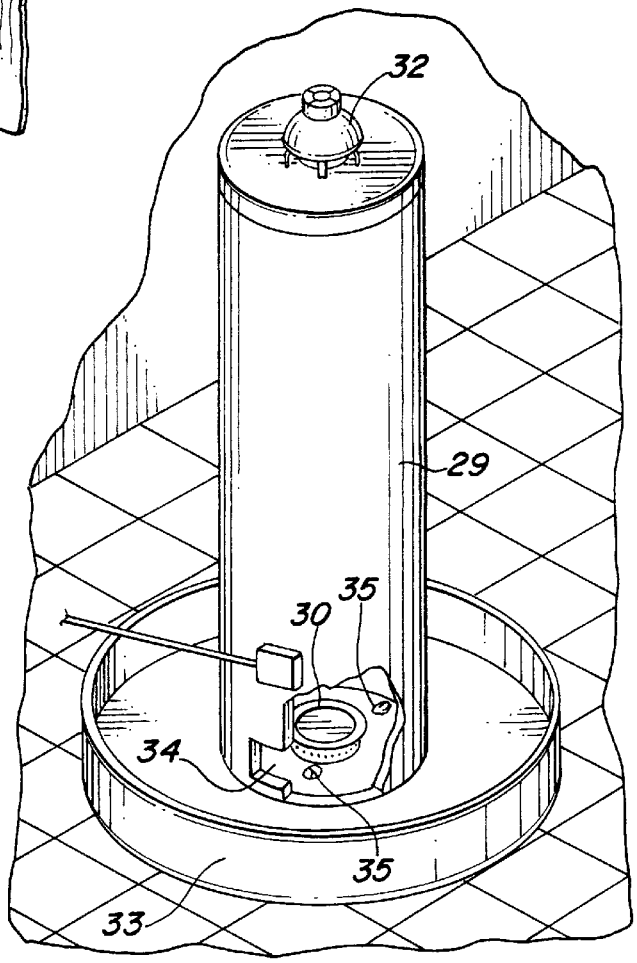
FIG. 12 is a schematic view of a hot water heater arranged for testing of the use of the present invention in protecting against gasoline spills.

Description of Baseline Test—Without the Flame Arrester of the Present Invention The residential water heater 29 utilized in this demonstration is shown in FIGS. 12 and 13. The heater had the following specifications:

Bottom-fired: natural gas, 33,000 Btu/hour

Standing pilot: natural gas, 1,000 Btu/hour

Burner: steel, multi-port, ring configuration

Water tank capacity: 30 gallons

Vent: central, 3-inch vertical flue

Cabinet style: "tall", 60 inches

The tank 29 included the standard components such as a main burner 30, a burner access panel 31, and a vertical flue vent 32. Positioned beneath the water heater 29 was a stainless steel moat 33, into which regular octane gasoline was poured to simulate an accidental spill. The natural gas supply line (not shown) was made of copper tubing to withstand the flames that resulted when the spill was ignited. Baseline tests consisted of exposing the as-received, water-filled, and operating water heater 29 to a deliberate gasoline spill to determine whether this simulated accident situation resulted in a fire in the moat.

First, the access panel 31 to the combustion chamber 34 was removed to light the pilot burner. Before replacing this panel, the main burner 30 was test fired, and then turned off. Main burner firing was conducted remotely using a special tool so that the technician was protected from any gasoline fire that might ignite in the moat. Once the pilot burner had been lit, and the access panel replaced, about 100 milliliters of gasoline was poured into the moat.

Baseline data consisted of a determination whether or not a gasoline fire occurred in the moat. Such fires would mean that gasoline vapor, entrained into the combustion chamber via the air entering the unit for natural gas combustion, either through the border of the access panel or the openings in the base, ignited, and then flashed out of the water heater to the gasoline vapors above the pool in the moat, igniting them. If such "flashback" did not occur under these conditions in about 5 minutes, an arbitrary time interval, the main burner was ignited to determine if it caused flashback and an external gasoline pool fire. Each baseline test was repeated 10 times so that a probability for flashback could be estimated.

The results of the baseline tests were: In all 10 trials, the water heater pilot flame alone was sufficient to ignite a gasoline pool fire in the moat beneath the gas appliance, 15–25 seconds after the gasoline was spilled.

Description of Water Heater Test with the Fire Arrester of the Present Invention in Place The test began by inserting 12 of the ellipsoids of the present invention into the openings 35 at the base of the water heater cabinet that allow air to enter the combustion chamber 34. The pilot and main burner 30 were then lit. The performance of neither appeared affected by the presence of the ellipsoids in the openings 35, implying that an unacceptable pressure drop was not introduced. The main burner 30 was then turned off. The access area was then filled with 1 contained layer 36 containing 32 ellipsoids of the present invention, which also had no apparent effect on the pilot or the main burner flames. The access panel 31 was replaced.

Ten tests were conducted with the ellipsoids of the present invention installed in this manner. A test was terminated if a fire did not occur after at least 30 minutes of exposure of spilled gasoline vapors to either the pilot flame, or the pilot and main burner flames. Ellipsoids were reinstalled for each test as a means to access the quality control of the installation process. Because visual access to the flames was lost when the ellipsoids were installed, confirmation of main burner ignition was established indirectly by listening for internal noises and watching for venting from the water tank pressure relief vent.

The results of the tests on use of the fire arrester of the present invention were: In none of the 10 tests with the ellipsoids in the air passages of the water heater did either the pilot flame, or the pilot and main burner flames, ignite any spilled gasoline, nor were these flames extinguished when the gasoline vapor/air mixture entrained into the burner chamber ignited, which was audible (popping noise), indicating that the layer of ellipsoids was containing the internal gasoline vapor/air "explosion".

Figure 14:
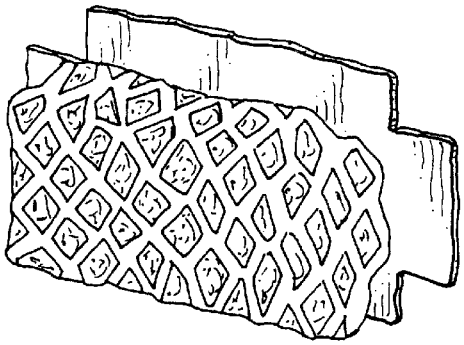
FIG. 14 is a perspective view of the flame arrester, adapted to fit in the access opening to the burner of the hot water heater shown in FIGS. 12 and 13.

FIG. 14 shows a preferred embodiment of a physical shape for the contained layer of ellipsoids adapted to fit in the access opening of the hot water heater.

Although preferred embodiments of the invention have been described herein in detail, it will be understood by those skilled in the art that variations may be made thereto without departing from the spirit of the invention.

What is claimed is:

1. A flame arrester adapted for placement in a conduit carrying a stream of flammable atmosphere for preventing an external flame at a downstream point in said stream from flashing back in an upstream direction to the source of said flammable atmosphere, said arrester comprising a layer of nested ellipsoids contained between front and back cover screens, said ellipsoids having an internal surface area of at least 250 $ft^2$ per $ft^3$ and being formed from expanded metal sheets made from magnesium alloy foil containing at least 3% magnesium and having a thickness in the range from 0.05–1.0 mm.

2. A flame arrester as in claim 1 wherein said stream of flammable atmosphere is an explosive mixture of air and gas traveling through a conduit in a closed combustion system.

3. A flame arrester as in claim 1 wherein said stream of flammable atmosphere is traveling through a vent pipe of a storage tank for a flammable substance.

4. A flame arrester as in claim 1 wherein said flame is the pilot or burner light of a hot water heater and the source of said flammable atmosphere is a fugitive mixture caused by the accidental spillage of fuel in the vicinity of said hot water heater.

5. A flame arrester as in claim 1 wherein said layer of ellipsoids is contained within a basket formed from an expanded metal net foil made from magnesium alloy.

6. A flame arrester as in claim 1 wherein theshort diameter of said ellipsoid is in the range of 20 to 30 mm and the long diameter is in the range of 30 to 45 mm.

7. In a fuel tank having a vent opening for releasing fuel vapors from said tank when the vapor pressure in said tank exceeds a predetermined value, a flame arrester mounted in said vent opening for preventing an external flame from flashing back into said tank, said arrester comprising a layer of nested ellipsoids contained between front and back cover screens, said ellipsoids having an internal surface area at least as high as 250 $ft^2$ per $ft^3$ and being formed from expanded metal sheets made from magnesium alloy foil containing at least 3% magnesium and having a thickness in the range from 0.05 to 1.0 mm.

8. A fuel combustion system comprising a device for producing a mixture of fuel and air, a burner for burning said mixture, a pipe connecting said mixing device and said burner for conveying said mixture to said burner, and a flame arrester mounted in said pipe for preventing flame from said burner from flashing back upstream to said mixing device, said flame arrester comprising a contained layer of nested ellipsoids contained between front and back cover screens, said ellipsoids being formed from expanded metal sheets made from magnesium alloy foil containing at least 3% magnesium and having a thickness in the range of 0.05 to 1.0 mm.

9. A process for preventing a supply of flammable atmosphere from being ignited by a flame burning externally of said atmosphere, comprising the step of placing between said flame and said atmosphere a flame arrester comprising a layer of nested ellipsoids contained between front and back cover screens, said ellipsoids being formed from expanded metal sheets made from magnesium alloy foil containing at least 3% magnesium and having a thickness in the range from 0.05 to 1.0 mm.

10. A process as in claim 9 wherein said layer of ellipsoids is contained within a basket formed from an expanded metal net foil made from magnesium alloy.

11. A process as in claim 9 wherein the short diameter of said ellipsoid is in the range of 20 to 30 mm and the long diameter is in the range of 30 to 45 mm.

* * * * *